US005460726A

United States Patent [19]

Beyrouty

[11] Patent Number: 5,460,726

[45] Date of Patent: Oct. 24, 1995

[54] PILLOW DISCHARGE APPARATUS FOR MINIMIZING OIL DISCHARGE FROM RUPTURED OIL TANKS

[76] Inventor: Louis Beyrouty, 6 Hickory Hill Dr., Ewing, N.J. 08618

[21] Appl. No.: 159,819

[22] Filed: Nov. 24, 1993

[51] Int. Cl.[6] ..... C02F 1/28

[52] U.S. Cl. ..... 210/693; 210/198.1; 210/924

[58] Field of Search ..... 210/693, 242.4, 210/350–352, 416.1, 472, 924, 198.1; 222/335, 397, 399

[56] References Cited

U.S. PATENT DOCUMENTS

| | | | |
|---|---|---|---|
| 4,371,101 | 2/1983 | Cane et al. | 222/335 |
| 4,981,097 | 1/1991 | Beyrouty | 114/228 |
| 5,248,436 | 9/1993 | Kovaletz | 210/924 |

*Primary Examiner*—Ivars Cintins

[57] ABSTRACT

An oil holding tank has an open upper end and a vertical container containing pillows when immersed in oil will rapidly adsorb oil and exhibit a composite density denser than oil and less dense than water. A horizontal member is disposed between the lower open end of the container and the upper end of the tank and having open and closed positions. The member is opened when the tank is ruptured to permit the pillows to be discharged by gravity into the tank. A first mechanism is placed in active position to apply a downward force to the uppermost layer of pillows in the container when the member is open to augment the force of gravity and is placed in inactive position and applies no downward augmenting force when the member is closed. The top level of oil in the tank prior to rupture is subjected to a combined pressure of air, vapors and inert gas which exceeds that of ambient air. An additional mechanism reducing the combined pressure after rupture to a value approximately equal to ambient air.

4 Claims, 2 Drawing Sheets

FIG. 1
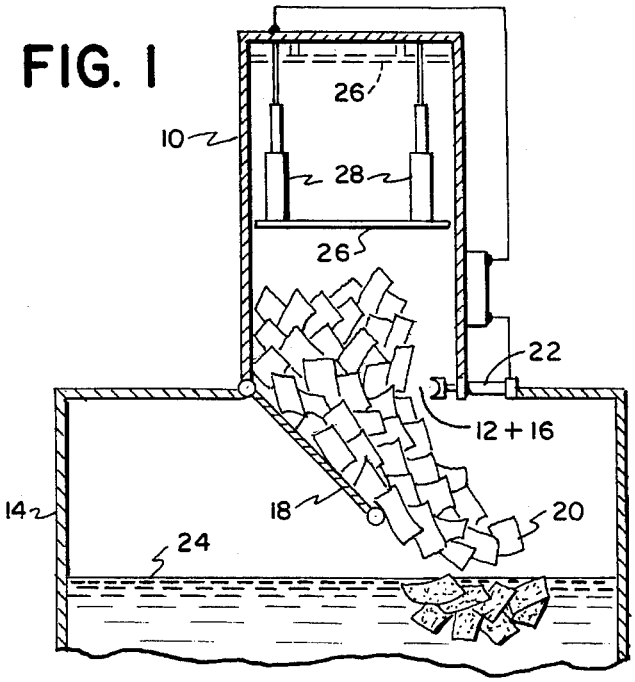
FIG. 2
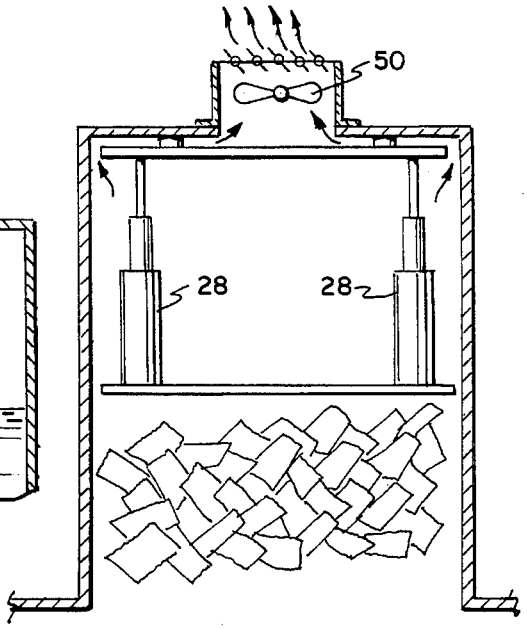
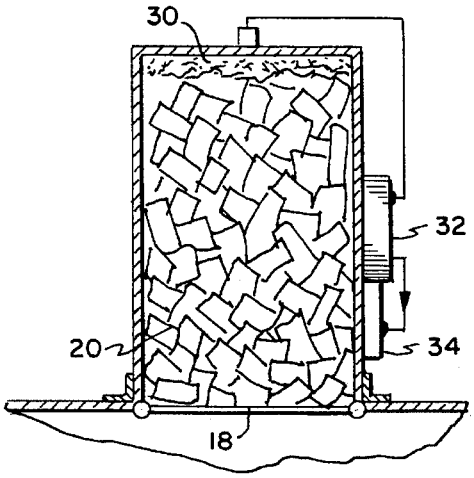
FIG. 3
FIG. 4
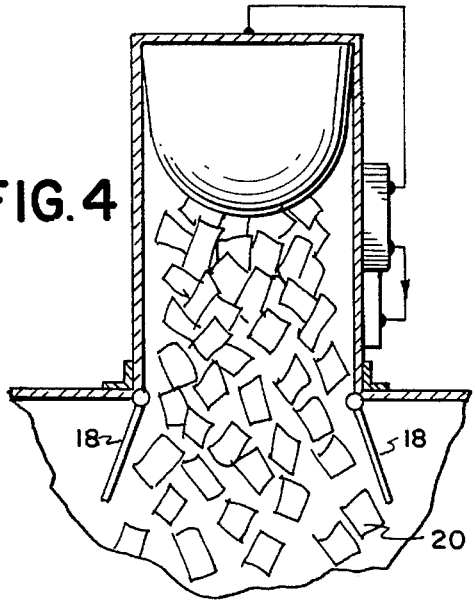

PILLOW DISCHARGE APPARATUS FOR MINIMIZING OIL DISCHARGE FROM RUPTURED OIL TANKS

This application is directed toward apparatus for minimizing the amount of oil leaked or discharged from an oil holding tank in an oil carrying vessel, such as an oil carrying tanker, when the vessel is in the water and the tank is ruptured.

CROSS REFERENCE TO COPENDING PATENT APPLICATION

The apparatus disclosed in this application utilizes pillows disclosed in copending application entitled "PILLOWS ADAPTED FOR USE ON BOARD OIL SPILL LIMITATION SYSTEM FOR OIL CARRYING TANKERS", filed on Aug. 25, 1993, Ser. No. 08/111426. The contents of this copending application are incorporated by reference herein.

BACKGROUND OF THE INVENTION

U.S. Pat. No. 4,981,097 discloses a system for closing an oil leaking rupture from an oil holding tank disposed in an oil carrying vessel disposed in water. This system includes a pillow storage container which is fixedly secured to the vessel above a hole in the deck of the vessel which overlies an open upper end of the tank and communicates therewith. The container and the tank are interconnected in an air tight fashion. The container can be pressurized and releasably contains a plurality of oil absorbent pillows. The container has at its open lower end a releasably disposed member disposed in the hole above the tank which, prior to release of the member, prevents the pillows from falling out of the container into the tank.

When the tank is ruptured below the water line, the floor of the container is automatically opened, and the pillows fall by gravity into the tank. The pillows fall downwardly though the oil by action of gravity and, upon reaching the rupture, seal off the rupture and prevent further loss of oil.

Subsequent to the issuance of U.S. Pat. No. 4,981,097, applicant conducted a series of experiments with this system. Applicant discovered that the pillows described in this known system will not function efficiently unless, as explained in the above identified copending application, these pillows, in addition to being oil adsorbent and impervious to water, also exhibit a density heavier than oil and lighter than water.

During this series of experiments, applicant also discovered that the use of gravity force alone, in causing the pillows to fall by gravity into the ruptured oil tank was not efficient because the pillows fell relatively slowly into the tank. However, when the gravitation force was substantially augmented by an additional downwardly directed force, the pillows were discharged into the ruptured oil tank with substantially increased speed, thus providing the desired increase in efficiency.

Applicant also discovered that this efficiency could be further increased by decreasing the vapor pressure in the upper end of the ruptured tank.

SUMMARY OF THE INVENTION

Accordingly, it is an object of the present invention to provide new and improved method and apparatus for developing an additional downwardly directed force to augment the force of gravity and increasing the speed at which pillows of the character indicated are discharged into a ruptured oil tank.

Another object is to provide new and improved method and apparatus wherein an additional downwardly directed force augments the force of gravity to increase the speed at which pillows of the character indicated are discharged into a ruptured oil tank and further wherein the vapor pressure in the upper end of the ruptured tank is reduced.

Still another object is to provide a new and improved method wherein an additional downwardly directed force is produced to augment the force of gravity to increase the speed at which pillows of the character indicated are discharged into a ruptured oil tank and in addition to reduce the vapor pressure in the upper end of the ruptured tank.

These and other objects and advantages of the invention will either be explained or will become apparent hereinafter.

As explained in more detail in said copending application, the pillows, to be oil absorbent, must contain a solid material which is oil absorbent. The preferred material is an open celled plastic foam, which initially is both oil absorbent and water absorbent. The material from which the foam is produced has a density which is normally greater than water, but since the open cells are initially filled with air, the foam has an initial composite density less than oil.

This raw foam is treated with a polymer which exhibits the dual proporties of promoting rapid oil adsorption and at the same time preventing water adsorption. The polymer is adsorbed onto the foam fibers and acts like an oil wick. As soon as the polymer containing foam is placed in oil, the oil is rapidly absorbed and replaces the air in the open cells, and the pillow becomes fully saturated with oil very quickly. The pillow clings to oil like a magnet, drawing it in and interacting with the oil molecules to hold them tightly together. The fibers in the pillow do not absorb oil into the fiber; the oil is adsorbed onto the fiber. The oil saturated polymer containing foam then has a composite density heavier than oil and lighter than water.

The pillows are stored in a vertically oriented container open at a lower end. An oil tank disposed below the container has an open upper end. The container and the oil tank are interconnected together in an air-tight manner so that air cannot leak into the container or the tank. In addition, a horizontal door type member having open and closed positions is disposed adjacent the open end of the container. The member is normally in closed position and prevents the pillows from falling into the tank. The member is placed in the open position when the tank is ruptured so that the open end of the container then communicates with the open end of the tank.

Whenever a rupture occurs, oil begins to leak out into the water surrounding the vessel, and because oil has a lower density than water, the oil begins to move upward in the surrounding water toward the surface thereof. As the oil leaks outward, water begins to enter the tank via the rupture.

The pillows have a density larger than that of oil and smaller than that of water. Consequently, some of the pillows will be entrained in the flow of oil to the rupture and will be caught and positioned within the rupture, slowing the rate of oil discharge, while other pillows will be positioned at the oil-water interface, creating a blanket which forms a barrier which further slows the discharge of oil.

The pillows fall by gravity into the tank and become saturated with oil. Since the pillows initially display a density less than that of oil, the pillows dropping by gravity will float initially upon the surface of the oil and then will not sink into the oil prior to adsorbing enough oil to have a density greater than that of oil.

In accordance with the invention, as soon as the open ends of the container and tank communicate with each other, an additional downward force is applied to the pillows to augment the force of gravity, and the pillows are expelled into the oil. The pillows so expelled adsorb oil very quickly. The net result is that the pillows are moved into proper sealing position with much greater speed after a rupture occurs, thus minimizing the loss of oil because of tank rupture.

The tank prior to rupture contains a vertical oil column which extends upward from the bottom of the tank toward its open end. When rupture occurs below the water line, the lower portion of the column will be displaced by water to the uppermost point of the rupture. The oil is forced out at the upper region of the rupture while the water is forced inwardly at the lower region of the rupture. The weight of the oil column produces a downward flow of oil to replace the oil that is discharged.

Consequently, oil will be discharged from the tank into the surrounding water because of two different but interacting causes. The first cause of oil loss occurs because oil originally located below the rupture is displaced by the higher density water. The second cause of loss occurs because oil originally located above the level of rupture continues to flow downward to this level and then outward through rupture.

The second cause of oil loss has two components which are added together. The first component is produced by the pressure developed by the weight of that portion of the oil column disposed above the rupture. The second component is produced by the added pressure of air and other vapors entrapped in the container and upper end of the tank. This added pressure is essentially at the same pressure of air surrounding the container. Since the container and tank are interconnected in an air tight manner, the weight of all the vapors if fixed and cannot change unless the tank and/or container is vented. Prior to rupture, this weight produces the second component of pressure. After rupture, as the top level of the oil disposed above the rupture flows downwardly, the second component of pressure decreases below that of the ambient air, because the volume of vapors increases, but the weight of the vapors is unchanged. This reduction in pressure causes the rate of discharge of the oil column disposed above the rupture to decrease.

However, because of present Federal Regulations, the volume between the top level of oil in the tank and the horizontal member, prior to rupture, must be pressurized by an inert gas, to reduce risks of fire, explosion and the like. When this pressurization takes place, the combined pressure of air, other vapors and the inert gas is several pounds per square inch higher than that of the ambient air. Consequently, upon rupture, the second component of pressure is higher than it would have been in the absence of inert gas pressurization, and the rate of discharge of the oil column disposed above the rupture is higher than it would have been in the absence of inert gas pressurization.

In the present invention, a new and improved method and apparatus is employed to reduce the combined pressure of air, other vapors and inert gas to about ambient air pressure, thus reducing the rate of oil loss in that portion of the oil column disposed above the rupture. Typically, this is reduction is accomplished, after the pillows have been expelled into the tank, by discharging enough air, vapors and inert gas through a suitable vent in the upper end of the container in such manner as to reduce the combined pressure as required.

Thus, in this invention, use of a force augmenting gravity minimizes the rate at which that portion of the oil column disposed below the rupture is discharged into the water surrounding the vessel. Also, in this invention, the reduction of the combined pressure of air, vapors and inert gas at the upper end of the oil column decreases the rate of loss of oil from that portion of the air column disposed above the rupture. The net result is a greatly reduced rate of total loss of oil.

BRIEF DESCRIPTION OF THE DRAWINGS

FIG. 1 illustrates the discharge of pillows into an oil tank under the combined forces of gravity and a horizontal pressure plate moved downward by solenoid action.

FIG. 2 illustrates the discharge of pillows into an oil tank under the combined forces as shown in FIG. 1 and in addition illustrates apparatus for controlling pressure at the upper end of the air column.

FIG. 3 illustrates a container of pillows with a horizontal door type member closing of the lower open end and having a deflated balloon type bladder disposed in the upper end of the container.

FIG. 4 illustrates the structure of FIG. 3 when the member is open and the unit is inflated.

DETAILED DESCRIPTION OF PREFERRED EMBODIMENTS

Figure 5:
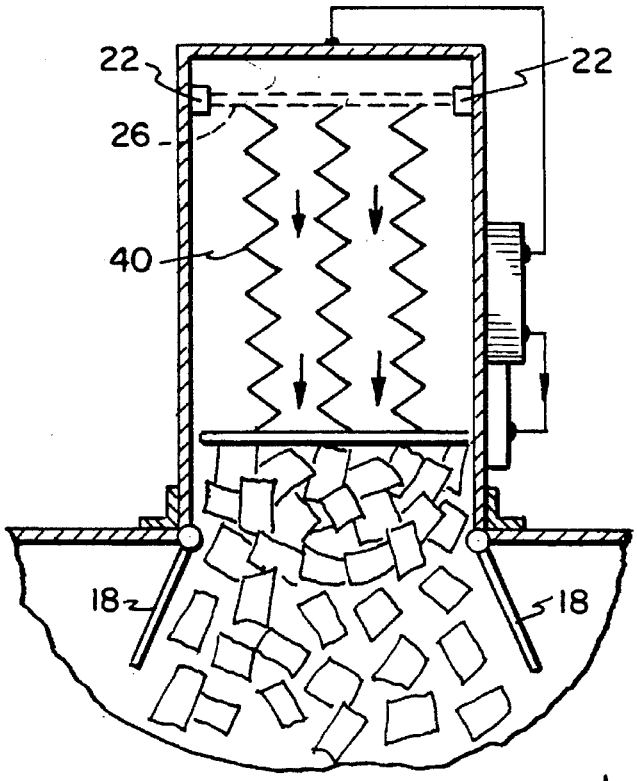
FIG. 5 illustrates a structure similar to that of FIG. 1 wherein the pressure plate is moved downward by expanding previously compressed springs.

Referring first to FIG. 1, a vertical container 10 open at its lower end 12 is connected in an air tight manner to an oil tank 14 having an open upper end 16. The open end of the tank contains entrapped air as well as various gases produced by the oil in the tank. A horizontal door type member 18 has a horizontal closed position and a downward inclined open position. The container contains pillows 20 of the type described in the above referenced copending application and also contains some entrapped air. Member 18 is normally retained in closed position by electrically operated apparatus 22. (One known form of member 18 and apparatus 22 can be as shown in FIGS. 2–4 of U.S. Pat. No. 4,981,097). When the apparatus is electrically actuated, the apparatus releases the member which pivots downwardly under its own weight into an inclined position at which the pillows will fall by gravity into the oil 24 in the tank.

In addition a horizontal pressure plate 26 is normally held in raised position within the container 10 by solenoids 28 having normally withdrawn pistons as shown in dotted line. When the member 18 is placed in open position, the solenoids are actuated and their pistons are extended, moving plate 26 downward to augment the downward force exerted on the pillows as previously described.

When a rupture occurs, the pilot or captain on the bridge of a vessel will see it or will be informed immediately and will close a switch to electrically release the member and actuate the solenoids, thus initiating the process for minimizing the loss of oil. Known systems, electrical and/hydraulic, used for this purpose, are not shown in the drawings.

Referring now to FIGS. 3 and 4, a normally deflated balloon type bladder 30 is disposed in the container 10 at its upper end, with member 18 in closed position. When a rupture occurs, member 18, which in this example has two mating halves, is placed in open position and the pillows 20 fall downward by gravity. The member has a gas receiving inlet connected by a normally closed electrically operated valve 32 to a tank 34 of suitable gas under pressure, as for example, carbon dioxide. When a rupture occurs, the valve is electrically opened and the bladder is rapidly inflated. The expansion of the bladder augments the downward force on the pillows as previously described.

FIG. 5 shows another arrangement for forcing the horizontal pressure plate 26 downward as shown in FIG. 1. In FIG. 5, normally expanded springs 40 are held in compressed position against plate 26 when the plate is held in raised position by electrical apparatus 22 as shown in dotted line. When a rupture occurs, apparatus 22 releases the plate 26 and the springs expand and force the plate downward.

Figure 6:
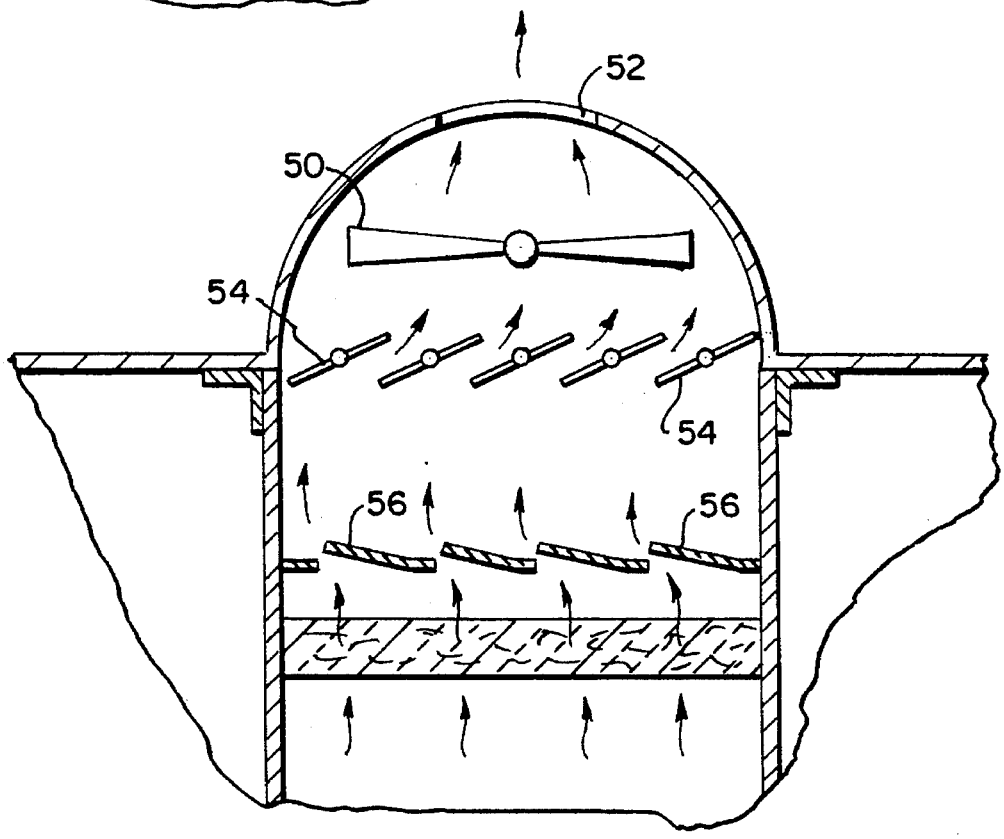
FIG. 6 is a detail view illustrating pressure controlling apparatus usable in the structure shown in FIG. 2.

FIG. 2 utilizes the apparatus of FIG. 1 and also employs apparatus for for reducing the combined pressure of air, vapors and inert gas at the upper end of the air column from a condition of pressure above ambient air to a pressure essentially the same as ambient. A detail view of such pressure control apparatus is shown in FIG. 6.

A known type vapor exhaust fan 50, used for example in ventilation systems for kitchens of restaurants, is disposed within the container at the top of the container. The upper end of the container has an exhaust vent 52, normally closed by louvers 54, which are only opened by air pressure when the fan operates. The fan will be actuated when a rupture occurs to maintain a reduction in combined pressure at the upper level of oil in the tank, originally at a value of about one or two pounds per square inch above that of ambient air, to a value approximately equal to that of ambient air.

A louvered gate 56 at the lower end of the fan will be so weighted or spring loaded to insure that the louvers will only pull up [open position] when the combined pressure exceeds that of ambient air. The mixture of air, vapors and inert gases will then be expelled until the desired value is attained at which point the louvers will close. The net result is a reduction of pressure of about one or two pounds per square inch.

While the invention has been described with particular reference to preferred embodiments, the protection sought is to be limited only by the terms of the claims which follow.

What is claimed is:

1. In combination with an oil holding tank having oil therein, the tank having an open upper end and being subject to rupture, and a vertical container containing pillows which initially have a density less than oil but which when immersed in oil will rapidly adsorb oil and exhibit a composite density denser than oil and less dense than water, the container and tank being interconnected in an air tight fashion, said container having an open lower end overlying the open upper end of the tank:

an horizontal door type member disposed between the lower open end of the container and the upper end of the tank and having open and closed positions, first means connected to said member to open said member when the tank is ruptured whereby the pillows are discharged by gravity into the tank and to close the member in the absence of tank rupture to prevent the pillows from being discharged by gravity into the tank, and second means having first and second positions and being actuated by and being responsive to movement of the member, said member when open placing the second means in the first position, the second means when in the first position exerting a downward force upon the uppermost layer of pillows in the container to augment the force of gravity thereon whereby the pillows are projected into the oil with much greater force than would act upon the pillows if only the force of gravity were present, said member when closed placing said seconds means in the second position at which said second means does not exert any downward augmenting force upon said pillows, said second means including a vertically movable horizontal plate disposed in the container, the plate being disposed above all of the pillows when the second means is in the second position and engaging and exerting said downward force upon said uppermost layer of pillows when the second means is in the first position.

2. The combination at set forth in claim 1 wherein the oil in the tank has a top level disposed below the upper end of the tank, the region between the top level of the oil and the member containing a combination of trapped air, vapors and inert gas said region having a total pressure which exceeds that of ambient air when the member is closed, the combination further including additional means for reducing said total pressure when the member is open to a value approximately equal to ambient air.

3. The combination of claim 2 wherein said additional means includes a vent in the upper end of the container which can be opened or closed and an exhaust fan disposed in the container below the vent and above the pillows, the fan when actuated opening the vent, the vent being closed when the fan is deactuated, the exhaust fan being actuated only when the total pressure exceeds that of ambient air.

4. A method for use with a oil holding tank having oil therein and having an open upper end, said tank being subject to rupture, and a vertical container containing pillows which initially have a density less than oil but which when immersed in oil will rapidly adsorb oil and exhibit a composite density denser than oil and less dense than water, said container having an open lower end overlying the open upper end of the tank, the container and tank being connected together in an air tight manner, a horizontal door type member being disposed between the open end of the tank and the open end of the container, the member having open and closed positions, a vertically movable horizontal plate disposed in the container, the plate being raised above all of the pillows when the member is in the closed position and being lowered to engage and exert a downward force upon an uppermost layer of pillows when the member is in the open position, said method comprising the steps of:

(a) opening the member when the tank is ruptured whereby the pillows are discharged by gravity into the tank;

(b) when the member is open, moving said plate downward to engage and exert said downward force upon said uppermost layer of pillows to augment the force of gravity thereon whereby the pillows are projected into the oil with much greater force than would act upon the pillows if only the force of gravity were present; and (c) closing said member when the tank is not ruptured, whereby said pillows cannot be discharged into the tank; and (d) when the member is closed, moving said plate into raised position.

* * * * *